United States Patent [19]

Colosio

[11] Patent Number: 4,539,825

[45] Date of Patent: Sep. 10, 1985

[54] DEVICE SELECTING THE NEEDLES ON THE DIAL PLATE OF EITHER SINGLE OR MULTIPLE FEED, SINGLE CYLINDER CIRCULAR KNITTING MACHINES FOR THE MANUFACTURE OF RIBBED FABRIC

[75] Inventor: Cesare Colosio, Botticino Sera, Italy

[73] Assignee: Colosio Cesare S.r.l., Italy

[21] Appl. No.: 498,964

[22] Filed: May 27, 1983

[30] Foreign Application Priority Data

Jun. 9, 1982 [IT] Italy ..... 5177 A/82

[51] Int. Cl.[3] ..... D04B 9/22; D04B 9/06; D04B 35/00

[52] U.S. Cl. ..... 66/24; 66/25; 66/145 R; 66/225

[58] Field of Search ..... 66/15, 24, 25, 95, 140 S, 66/145 S, 225, 145 R

[56] References Cited

U.S. PATENT DOCUMENTS

| | | | |
|---|---|---|---|
| 2,153,019 | 4/1939 | Holmes | 66/24 |
| 2,391,665 | 12/1945 | Wildt et al. | 66/24 |
| 3,148,518 | 9/1964 | Peel et al. | 66/225 X |
| 3,641,790 | 2/1972 | Grewcock et al. | 66/140 S |

FOREIGN PATENT DOCUMENTS

| | | | |
|---|---|---|---|
| 2117125 | 10/1971 | Fed. Rep. of Germany | 66/24 |
| 461016 | 2/1937 | United Kingdom | 66/25 |
| 1,139,539 | 1/1969 | United Kingdom | 66/140 S |
| 1377141 | 12/1974 | United Kingdom | 66/25 |
| 2099463 | 12/1982 | United Kingdom | 66/25 |

*Primary Examiner*—Wm. Carter Reynolds
*Attorney, Agent, or Firm*—McGlew and Tuttle

[57] ABSTRACT

A device for selecting the needles on the dial plate of single cylinder circular knitting machines for the manufacture of ribbed fabric, said device comprising a coaxial sleeve secured on top of the dial plate and revolving with the dial plate and, as many swinging elements or jacks as there are needles on the dial. Each jack slides in a vertical groove which is defined in the sleeve and which coincides with a needle groove in the dial. Slides are selected to vertically displace the jacks from an operating position into a rest position. A pinned drum controls selectors and cams to control the swinging motions of the jacks when they are in operating position in order to control the radial displacements of the corresponding needles by means of the thus operated jacks.

4 Claims, 8 Drawing Figures

Fig. 2
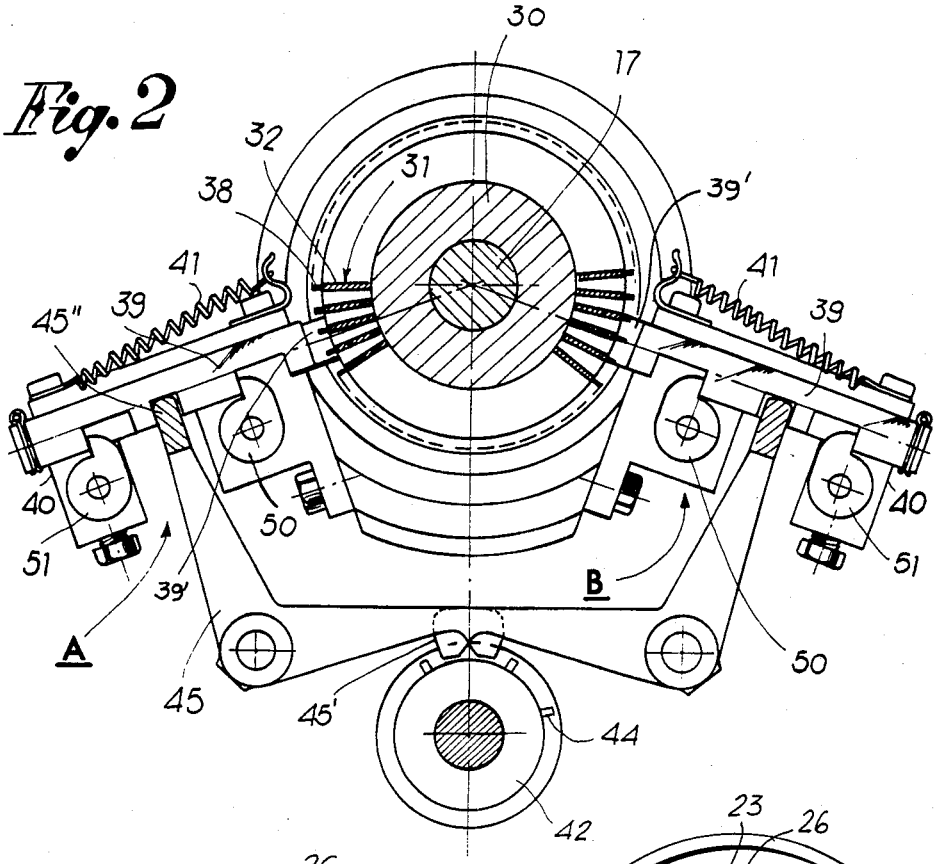
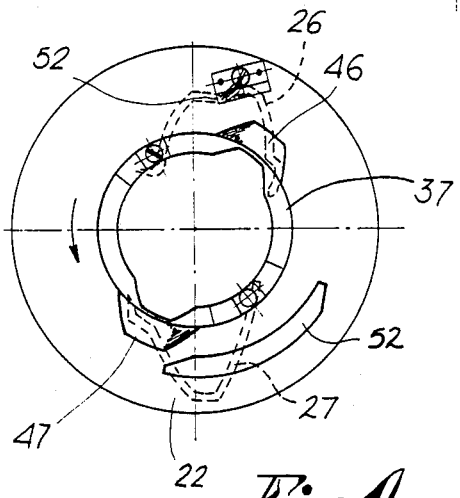
Fig. 4
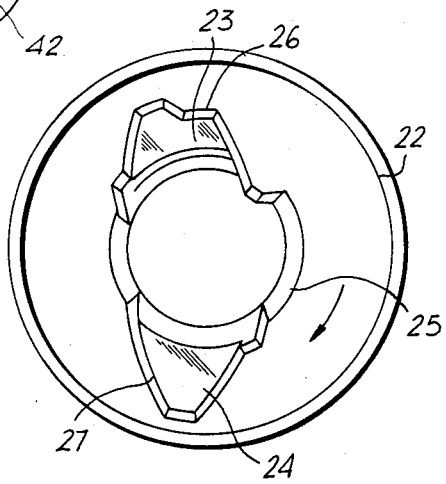
Fig. 3

DEVICE SELECTING THE NEEDLES ON THE DIAL PLATE OF EITHER SINGLE OR MULTIPLE FEED, SINGLE CYLINDER CIRCULAR KNITTING MACHINES FOR THE MANUFACTURE OF RIBBED FABRIC

FIELD AND BACKGROUND OF THE INVENTION

There are some known circular knitting machines which are fitted with a certain number of vertical needles mounted on a cylinder and a number of horizontal needles mounted on a dial placed on top of and revolving with said cylinder to allow a co-operation of the vertical and horizontal needles in knitting ribbed fabrics according to a given selection, perforated fabrics, patterned or plain fabrics, by transferring meshes from horizontal to vertical needles or by excluding said horizontal needles from operation.

In said known machines the dial bearing the horizontal needles is fitted with a stationary cover equipped with cam means to control the radial reciprocating displacements of horizontal needles and to guide said needles along an inactivating track.

In some embodiments the horizontal needles on one half of the dial have butts which are higher than the butts of the needles on the other half of the dial. In this case ribbed fabrics can only be made using all the needles on the dial plate and then, if necessary, at least half of the dial needles may be selected to transfer their meshes to the vertical cylinder needles as is usually done at the beginning of of heel and sole of a stocking.

In some other embodiments the dial plate is provided with more than two rows of horizontal needles, the needle butt height being different in each needle row. The availability of needles with butts of different heights increases the selectivity of said needles to produce differently ribbed or perforated fabrics as well as other patterns and also allows the selection of the needles designed for the transfer of meshes to the vertical cylinder needles. At any rate, selection of horizontal needles on the dial plate is so far obtained by either fixed or movable cam devices fitted to the stationary cover and acting only on the butts of said needles.

A system of this kind implies however some difficulties and both practical and functional limitations, as the height difference between butts of several needle rows cannot be too great, as otherwise the space required by the dial plate would be too large. In addition, the control cams acting on the higher butts might bend or warp said butts and thus cause needle jamming or an inaccurate selection.

If several needle rows with butts having different height are used, the needles with butts of the same height can only be selected all together and in the same way according to a fixed and unchangeable selection, it being impossible to select only some needles out of a row, thus preventing the production of different patterns as is often desirable and required.

The dial plate with horizontal needles is normally also equipped with a thread saw which generally projects from the dial plate circumference at least as much as its teeth are long. At any rate, the teeth of said saw must be within the circumference on which the vertical cylinder needles are placed and the dial plate diameter must therefore be comprised within certain limits. On the other hand, by restricting the diameter of the dial plate its supporting and guiding possibilities will also be reduced, in particular when its horizontal needles are taken to the outside and thus overhang by a large amount.

SUMMARY OF THE INVENTION

Now the objects of the present invention relating to a device for selecting the horizontal needles on the dial plate of circular knitting machines designed for the manufacture of ribbed fabrics are the following:

- to perform an accurate and individual needle selection in order to obtain any kind of knitted fabric or pattern;
- to achieve the individual selection of the horizontal needles which have to transfer their meshes to the corresponding vertical cylinder needles;
- to carry out both the above stated selections on horizontal needles also simultaneously in two different portions of the dial plate and by means of only one actuating element;
- to use and mount on the dial plate horizontal needles having all the same height, in order to eliminate the necessity of having different kinds of needles available and to arrange them as required from time to time;
- to achieve a more accurate and flexible selection of horizontal needles and thus a larger choice of patterns than that obtained by conventional selecting means;
- to individually and independently control each needle by its corresponding jack, thus eliminating the conventional cams fitted to the cover of the dial; and
- to reduce at least the height of the dial plate itself in order to equip it with a newly designed thread trimming saw featuring a structure also allowing an increase of the outer diameter of the dial plate for a more correct guide of the horizontal needles as they are radially towards the outside.

The objects of the invention will be more evident from the detailed description set forth hereinafter illustrated in the accompanying drawings in which:

BRIEF DESCRIPTION OF THE DRAWINGS

FIG. 2 is a cross-sectional view of said device taken along line II—II in FIG. 1;

FIG. 3 is a bottom plan view of the dial plate cover showing the looping and transfer cams taken from the underside of the cover;

FIG. 4 is a top plan view of the same cover with cams controlling the angular displacements of jacks;

Figure 1:
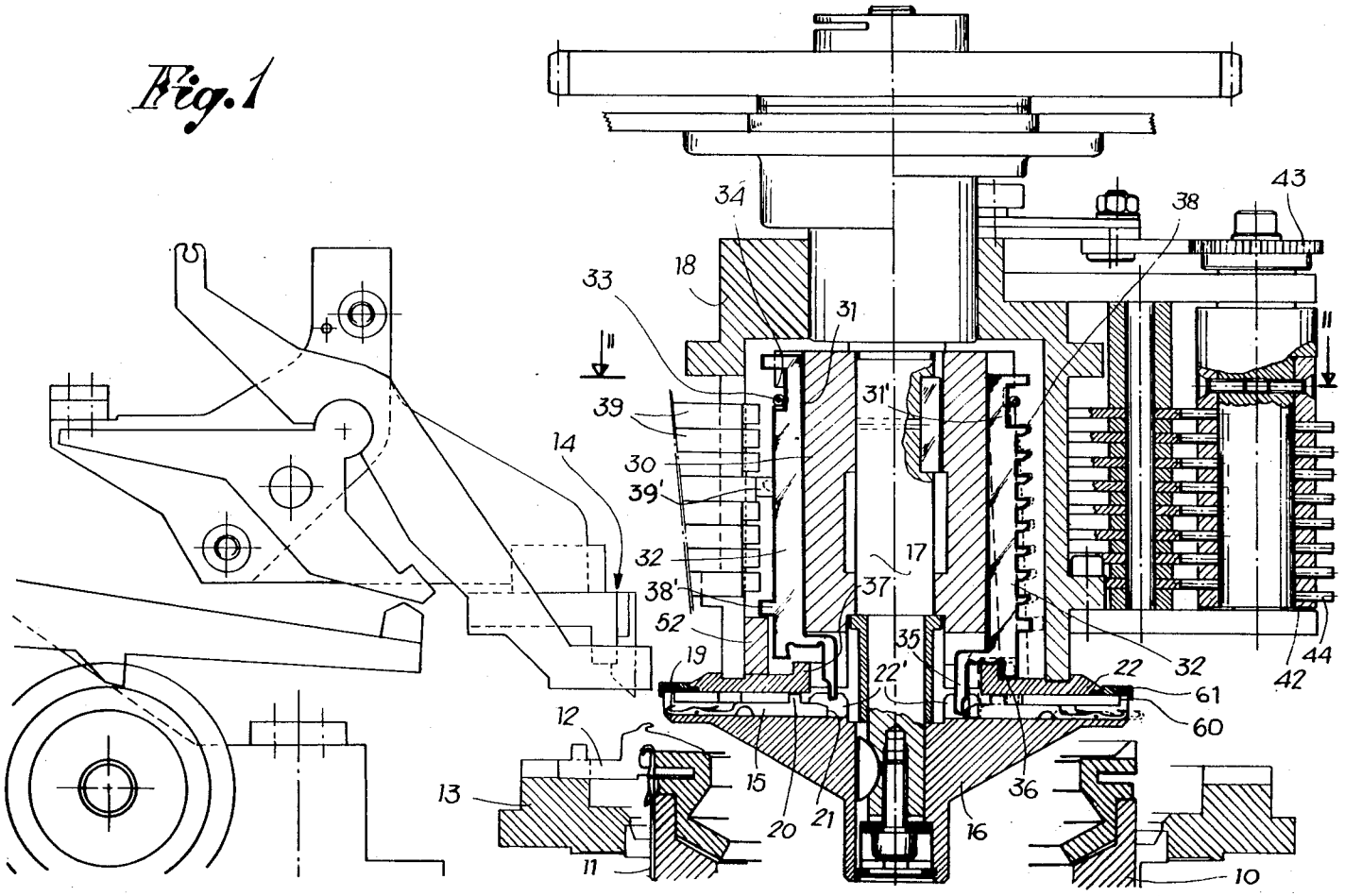
FIG. 1 is a sectional view of the dial plate of a circular knitting machine fitted with a device to select horizontal needles according to the invention.

With reference to the drawing a circular knitting machine comprises a cylinder 10, on the external surface of which vertical needles 11 are slidable by means of stitch cams (not shown) and co-operating as usual with sinkers 12 which are mounted and movable on a supporting ring 13 fixed on and revolving together with cylinder 10. On top of said cylinder a supporting dial plate 16 is provided, on which a plurality of horizontal needles 15 is radially slidable from its centre to its rim and vice-versa in suitable grooves, so as to co-operate with the vertical needles 11 on cylinder 10. The number of said horizontal needles 15 is, for instance, the same as half the number of the cylinder needles 11, the horizontal needles being arranged in such a way that they meet with the resting vertical needles alternating the operating cylinder needles. Each horizontal needle 15 has a beak 19 extending towards the rim of plate 16, an intermediate upward butt 20 and a tail 21 turned to the centre of dial 16.

The dial plate 16 is splined on a vertical shaft 17 supported on machine frame 18 and synchronously revolving with cylinder 10, it being driven by a known transmission.

A stationary cover 22 fixed on frame 18 is placed over the revolving dial 16 with horizontal needles 15, said cover being fitted with cams delimiting the rest and operating strokes of horizontal needles 15. Thus, for instance, for a circular knitting machine with a feeding station 14, said stationary cover is fitted (FIG. 3) with cam means 23 and 24 delimiting: an annular track 25 for butts 20 of horizontal needles 15 when they are in a central position and have to be kept out of operation, a cam track 26 for the reciprocating motion of horizontal needles 15 to catch the thread or threads for looping and a cam track 27 for the reciprocating motion of needles 15 while they take meshes to the vertical needles 11 on cylinder 10.

Now a selection is made available for the horizontal needles 15 to be passed from rest track 25 to cam track 26 for looping or, when necessary, from rest track 25 to cam track 27 for transfer, said selection acting on the single needles by radially pushing outwards tail 21 of the relevant needle to get its butt 20 into cam track 26 or 27 according to request.

The advantage of this kind of selection is the possibility to use horizontal needles 15 all having butts 20 of the same height, as selection takes place independently from the height of butts which have only to guide horizontal needles along the given tracks and keep them in their resting, looping or transfer position.

To this end the selecting device according to the invention comprises a sleeve 30 splined on shaft 17 of dial plate 16 and rotating with same. Along the generating lines of said sleeve 30 there are grooves 31 matching the radial grooves in dial plate 16, each groove 31 receiving a jack 32 corresponding to a horizontal needle 15 on dial 16. Said jacks 32 are kept inside their grooves 31 by at least one spring or retaining ring 33 fitted into an annular groove 34 near the top of sleeve 30 as well as into slots 31' in the upper end of jacks 32. Thus each jack 32 is vertically slidable in its groove 31 and also radially swingable on its fulcrum, i.e. on its end kept in place by the retaining ring 33.

The lower end of each jack 32 is bifurcated. Its longer leg 35 extends into the groove of the matching needle 15 in order to act on tail 21 and is guided by a jut 22' on dial plate 16. The short leg 36 of each jack extends towards the stationary cover 22 to co-operate with a cam ring 37 on top of the stationary cover 22.

Figure 5:
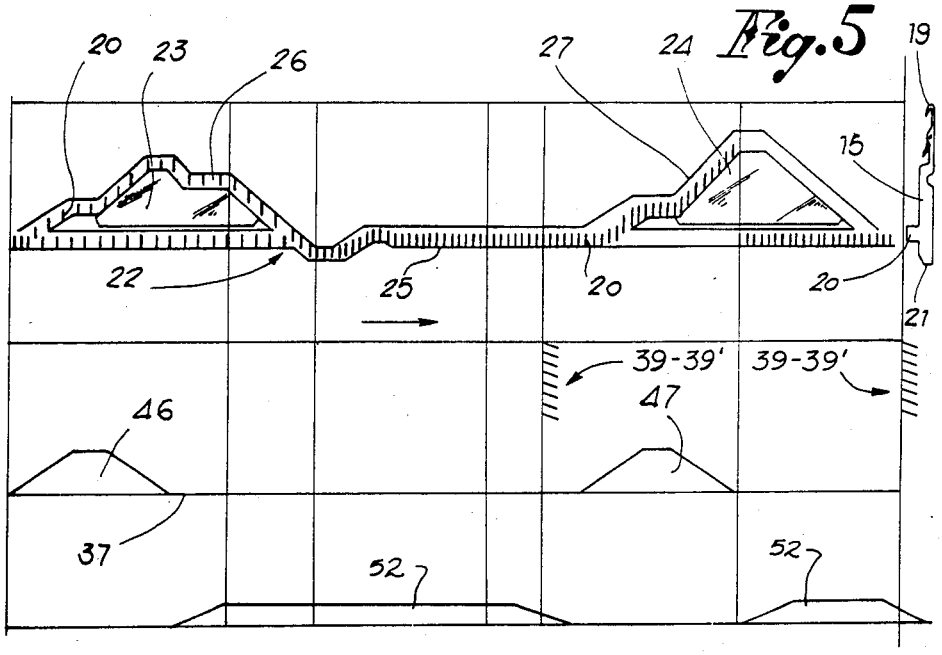
FIG. 5 is a composite diagram showing the correlated displacements of horizontal needles and jacks.

As shown in FIG. 4, said ring 37 is fitted with a first cam 46 placed, considering the sense of rotation of dial plate 16, before cam track 26 for looping, while a second cam 47 is placed before cam track 27 for transfer of meshes resulting inside the stationary cover 22 (also see FIG. 5). Said cam portions 46 and 47 will act on leg 36 of each jack 32 as soon as it comes down in order to select a horizontal needle 15 by its swinging movement. The direction of needle passage is shown by the arrows in FIGS. 3, 4 and 5, and the position of the cam tracks 26 and 27 are shown in dotted line in FIG. 4.

All along the vertical outer surface of jacks 32 a row of teeth 38 is arranged, which are removable according to a given sequence and the program requested. Matching said teeth 38 an equal number of selecting slides 39 will push down jacks 32 into their operating position. After the operative selection of needles, the jacks 32 are moved and kept again in their upper rest position by means of cams 52 provided on the stationary cover 22. The cams 52 act on a tooth 38' provided on each jack 32. Said selecting slides 39 are parcelled and guided on their support 40 (FIGS. 1 and 2) in a radial position with respect to the sleeve 30 and thus to the jacks, but they are also radially displaceable towards and away from said jacks.

In the above described embodiment there are two sliding units A and B for two different selections of horizontal needles 15 taking place in two different portions of the dial plate, i.e.: a sliding unit A placed before cam track 26 for looping and a unit B before cam track 27 for transfer to select the horizontal needles 15 passing meshes to vertical needles 11 on cylinder 10 as required.

Each selecting slide 39 has a sloping end portion 39' to engage on teeth 38 of jacks 32 to be moved downwards (FIGS. 1, 2, and 5). In addition, selecting slides 39 are subject to springs 41 which normally displace them towards jacks 32, and against means 50 (FIG. 2) inactivating the selectors and to means 51 adjusting the position of said selectors.

For the radial displacements of both selecting units A and B for the two different selections preferably one single pinned drum 42 is provided, it being however possible to mount a pinned drum for each selecting unit.

In the here described case the only pinned drum 42 is driven at the same speed as the cylinder 10 and the dial plate 16 by a transmission (not shown) acting on gear 43 fitted on drum 42. Depending on the fabric to be knitted said drum 42 is fitted with a given number of radial pins 44 meshing on ends 45' of two elbow levers 45 with opposite ends 45'' connected with the corresponding and plane-parallel selecting slides 39.

As a matter of fact, pins 44 on drum 42 control the angular displacements of elbow levers 45 as they meet them, thus taking the selecting slides 39 away from teeth 38 of jacks 32, so that they can be pushed upwards by disengaging cam 52. In these conditions jacks 32 are inactivated as legs 35, 36 at their bottom end are no longer in contact with horizontal needles 15 and cam ring 37 respectively.

Cam 52 as shown in FIGS. 4 and 5, is interrupted where the selection must take place by units A and B, to prevent lifting the jacks 32, when they are being held down by slide 39.

In consequence, the horizontal needles 15 corresponding to said jacks 32 are displaced to the centre of dial plate 16 and thus out of operation, with their butts 20 running in rest track 25.

On the other hand, when elbow levers 45 are positioned on a portion of drum 42 not fitted with pins 44 they do not act on the selecting slides 39 which are then taken towards teeth 38 of jacks 32 by their springs 41, said jacks 32 being thus pushed into their lowest position.

In this position leg 35 of jack 32 is engaged behind tail 21 of the corresponding horizontal needle 15, while the second leg 36 engages the cam ring 37 from the side.

Thus, when the leg 36 of each activated selector is running along the profile of cam or triangle 46 it will cause a radial swinging movement of the jack which, by means of its leg 35 will transmit a horizontal motion to the corresponding needle 15, which is this selected and displaced to get its butt into cam track 26 for looping.

It will thus be evident that by suitably arranging pins 44 on drum 42 any required needle selection can be achieved by acting on the single needles and independently from each other to produce any kind of pattern as it is known for the vertical cylinder needles.

When some meshes have to be transferred from horizontal needles to vertical cylinder needles, selecting slides 39 are moved as required to lower the relevant jacks 32 and place them before cam track 27.

This way, the leg 36 of the selected jacks will run along cam 47 of cam ring 37 on cover 22 and push the corresponding needles outwards to allow their butts 20 to reach and follow transfer track 27.

The correlation between the distances covered by the butts of the horizontal needles, the horizontal displacements of the needles operated by the jacks by means of cams 46, 47 and the vertical displacements of jacks is shown in FIG. 5 where the plot showing the vertical displacements of jacks is tilted by 90°.

Of course such a correlation may always be changed as required for the production of any kind of fabric without surpassing the limits of the present invention.

In conclusion, by means of a single control consisting of the pinned drum 42, 44 at least two different selections of the horizontal needles 15 on the dial plate of circular machines for ribbed fabric can be controlled, said selections being possible in any angular portion of the dial plate as by suitably shaping the cam ring 37, 46, 47 it is possible to guide the selected needles as and where it is desired and according to as many combinations or selections as there are teeth 38 on jacks 32.

Such a device also allows to give the dial plate a suitable dimension to ensure a correct radial guide of the needles 15, even when they are displaced in an outward direction. An additional feature of the present invention is the adoption of an improved trimming saw 60 to cut the newly threads.

Figure 6:
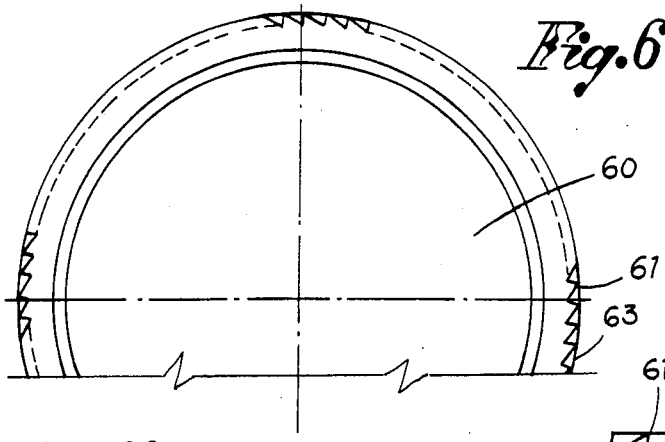
FIG. 6 is a partial view of the thread trimming saw.
Figure 8:
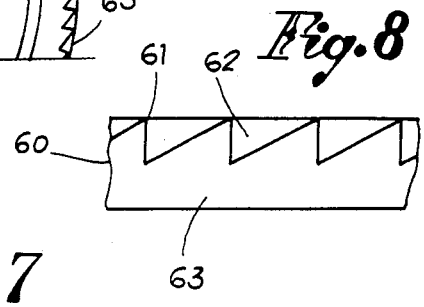
FIGS. 7 and 8 are enlarged sectional and lateral views of part of said trimming saw.
Figure 7:
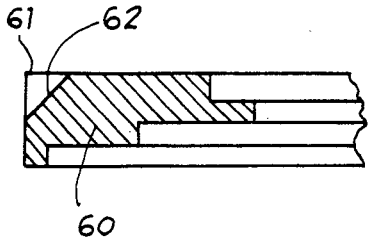

Said saw (FIGS. 6,7,8) comprises a row of teeth 61 delimited by peripheral recesses 62. The teeth 61 partly extend radially outwardly of the dial plate 16 (FIG. 1). Teeth 61 extend only partly through the full thickness or sectional height of the saw 60 as it happens in conventional devices of the kind (FIGS. 6, 7 and 8). This gives the teeth 61 a particular strength, their position allowing at least a partial overlapping of the dial plate, so that its diameter may be as large as allowed by the diameter of the needle cylinder. Section 63 of the peripheral thickness of the saw not involved by its teeth is coupled with the peripheral portion of the dial plate in order to prevent the threads from entering the slots for the horizontal needles.

I claim:

1. A device for selecting dial plate needles in a circular knitting machine for manufacturing ribbed fabric, comprising:

a frame (18);

a cylinder (10) rotatably mounted to said frame;

a plurality of vertical needles (11) mounted on said cylinder;

a dial plate (16) having a plurality of radial horizontal needle grooves and mounted for rotation with said cylinder;

a plurality of horizontal needles (15) each mounted in one horizontal needle groove of said dial plate, each needle having a butt (20) and a rear tail (21) extending radially inwardly toward a center of said dial plate;

a stationary cover (22) connected to said frame and disposed over said dial plate, said cover having an annular track (25) for receiving each needle butt (20) and for holding a horizontal needle connected to each butt in a radially inward rest position, said cover including at least one cam means (26) for engaging horizontal needle butts to move horizontal needles radially outwardly during a looping operation, and another cam means (27) for engaging horizontal needle butts to move horizontal needles during a mesh transferring operation for transferring a mesh to said vertical needles, said cover including further cam means (37), (46), (47);

a sleeve (30) rotatably mounted to said frame and above said dial plate for rotation with said dial plate, said sleeve including a plurality of vertical grooves each coinciding with a horizontal needle groove of said dial plate;

a plurality of jacks (32) each mounted for vertical sliding movement and radial swinging movement in one of said vertical grooves of said sleeve, each jack having a vertical edge with a row of teeth (38) therealong, each jack having a bifurcated bottom end with a long leg (35) extending toward and engaging in a horizontal needle groove of said dial plate radially inwardly of a corresponding horizontal needle (15) to act on a tail (21) of a corresponding needle, and a short leg (36) extending for engagement with said further cam means (37, 46, 47) of said cover (22), said further cam means controlling the swinging movement of said jacks when said jacks are in operating positions thereof, a plurality of selecting slides (39) mounted to said frame and cooperating with teeth (38) of said jacks (32) to control the selecting of vertical displacement of said jacks (32) from a rest position of each jack to said operating position of each jack; and at least one pin drum (42,44) mounted for rotation to said frame and rotatable with said cylinder, sleeve and dial plate, for selective displacement of said selecting slides (39) toward and away from said teeth (38) of said jacks (32), said pinned drum controlling said selecting slides to selectively move said jacks from said rest position to said operating position of said jacks, said further cam means operating to move selected horizontal needles outwardly for selectively engaging said at least one cam means (26) and said other cam means (27).

2. A device according to claim 1, including two sets of said selecting slides (39) positioned at circumferentially spaced locations around said sleeve (30), and only one pinned drum (42,44) for activating said selecting slides in each set of selecting slides.

3. A device according to claim 1, wherein said further cam means (37,46,47) on said stationary cover comprise at least one first cam (46) disposed at an angular position in part preceding said at least one cam means (26) for effecting a looping operation, with respect to a direction of rotation of said dial plate, and a second cam (47) disposed at an angular position in part preceding said other cam means (27) for effecting a transfer operation, with respect to the direction of rotation of said dial plate, said first and second cams (46,47) causing radial swinging movement of said jacks while in their operating position to selectively displace horizontal needles from their rest position into said one and other cam means (26,27) respectively.

4. A device according to claim 1, including a saw (60) mounted on said cover and extending over said dial plate, said saw having teeth (61) which are recessed and extend only partly through a sectional height of said saw, said teeth partly extending radially outwardly of said dial plate.

* * * * *